US011239596B2

(12) United States Patent
Miyakawa et al.

(10) Patent No.: US 11,239,596 B2
(45) Date of Patent: Feb. 1, 2022

(54) CONNECTOR

(71) Applicant: Yazaki Corporation, Tokyo (JP)

(72) Inventors: Tomoyuki Miyakawa, Tochigi (JP); Tomoyoshi Fukaya, Tochigi (JP); Kozo Oishi, Tochigi (JP); Hoshina Chisaka, Tochigi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/037,714

(22) Filed: Sep. 30, 2020

(65) Prior Publication Data

US 2021/0098925 A1 Apr. 1, 2021

(30) Foreign Application Priority Data

Oct. 1, 2019 (JP) ..... JP2019-181223

(51) Int. Cl.
*H01R 13/436* (2006.01)
*H01R 13/428* (2006.01)

(52) U.S. Cl.
CPC ..... *H01R 13/4361* (2013.01); *H01R 13/428* (2013.01)

(58) Field of Classification Search
CPC .. H01R 13/428; H01R 13/4361; H01R 13/40; H01R 13/422; H01R 13/4223; H01R 13/424; H01R 13/436; H01R 13/4362; H01R 13/4364; H01R 13/4365; H01R 13/4367; H01R 13/4368; H01R 13/502; H01R 13/506
USPC ..... 439/351, 353, 595, 752
See application file for complete search history.

(56) References Cited

U.S. PATENT DOCUMENTS

| | | | | |
|---|---|---|---|---|
| 5,256,083 | A * | 10/1993 | Yamamoto | H01R 13/4364 439/595 |
| 8,011,977 | B2 * | 9/2011 | Tsuruta | H01R 13/4365 439/752 |
| 8,226,436 | B2 * | 7/2012 | Suzuki | H01R 13/4364 439/595 |
| 8,747,156 | B2 * | 6/2014 | Hirabayashi | H01R 13/4223 439/595 |
| 9,774,123 | B2 * | 9/2017 | Sasaki | H01R 13/4364 |
| 2002/0173205 | A1 * | 11/2002 | Kato | H01R 13/4367 439/752 |

(Continued)

FOREIGN PATENT DOCUMENTS

JP 2003-45549 A 2/2003

*Primary Examiner* — Marcus E Harcum
(74) *Attorney, Agent, or Firm* — Kenealy Vaidya LLP

(57) ABSTRACT

A connector includes: a plurality of terminals; a housing having a tubular outer wall part, a holding part having a plurality of terminal housing chambers, lances positioned radially outside the respective terminal housing chambers, and a locking part; and a detection member having a tubular fitting part to be fit to the holding part and an engaging part. The lances, when the respective terminals are inserted into a regular position in the respective terminal housing chambers, enter the inside of the fitting part when the fitting part is fit to the holding part and, when the respective terminal are not inserted into the regular position, are pressed by the respective terminals to become deformed radially outward and to lock the fitting part at a first position, the first position being short of a position at which the engaging part is engaged with the locking part.

8 Claims, 15 Drawing Sheets

(56) References Cited

U.S. PATENT DOCUMENTS

| | | | | |
|---|---|---|---|---|
| 2009/0035993 | A1* | 2/2009 | Okayasu | H01R 13/5208 439/607.41 |
| 2010/0062660 | A1* | 3/2010 | Itou | H01R 13/4362 439/752 |
| 2012/0258623 | A1* | 10/2012 | Nawa | H01R 13/562 439/587 |
| 2012/0329299 | A1* | 12/2012 | Kitajima | H01R 12/716 439/147 |
| 2015/0038022 | A1* | 2/2015 | Kataoka | H01R 13/426 439/752 |
| 2015/0147918 | A1* | 5/2015 | Matsuda | H01R 13/5841 439/694 |
| 2015/0263451 | A1* | 9/2015 | Hashimoto | H01R 13/432 439/353 |
| 2015/0349470 | A1* | 12/2015 | Horiuchi | H01R 13/6273 439/353 |
| 2017/0069996 | A1* | 3/2017 | Yamada | H01R 13/4367 |
| 2018/0069353 | A1* | 3/2018 | Nishiyama | H01R 13/7032 |
| 2018/0102613 | A1* | 4/2018 | Ishida | H01R 13/7032 |
| 2018/0331452 | A1* | 11/2018 | Iida | H01R 13/4361 |
| 2019/0229467 | A1* | 7/2019 | Imai | H01R 13/641 |

* cited by examiner

CONNECTOR

CROSS-REFERENCE TO RELATED APPLICATION(S)

The present application claims priority to and incorporates by reference the entire contents of Japanese Patent Application No. 2019-181223 filed in Japan on Oct. 1, 2019.

BACKGROUND OF THE INVENTION

1. Field of the Invention

The present invention relates to a connector.

2. Description of the Related Art

There have conventionally been connectors having a terminal housing chamber. Japanese Patent Application Laid-open No. 2003-45549 discloses a holder integrated connector including a connector housing having a terminal locking lance and a front holder integrated with a housing main body to define a terminal housing chamber. The front holder of Japanese Patent Application Laid-open No. 2003-45549 has a wall part that enters a bending space of the locking lance to prevent the bending of the locking lance.

A connector preferably has a detection member that can detect whether terminals are properly inserted into a regular position. When the strength of the detection member is attempted to be ensured, the detection member increases in size, which is likely to lead to an increase in the size of the connector.

SUMMARY OF THE INVENTION

An object of the present invention is to provide a connector that can achieve both ensuring the strength of the detection member and preventing an increase in the size of the detection member.

In order to achieve the above mentioned object, a connector according to one aspect of the present invention includes a plurality of terminals; a housing having a tubular outer wall part, a holding part extending along an axial direction of the outer wall part and having a plurality of terminal housing chambers, lances supported on the outer wall part and positioned radially outside the respective terminal housing chambers, and a locking part; and a detection member having a tubular fitting part to be fit to the holding part along the axial direction and an engaging part to be engaged with the locking part, wherein the terminal housing chambers are disposed along a circumferential direction around a center line of the housing, the lances, when the respective terminals are inserted into a regular position in the respective terminal housing chambers, are engaged with the respective terminals to lock the respective terminals and, when the fitting part is fit to the holding part, enter an inside of the fitting part to allow the engaging part to be engaged with the locking part, and the lances, when the respective terminals are not inserted into the regular position, are pressed by the respective terminals to become deformed radially outward and to lock the fitting part at a first position, the first position being short of a position at which the engaging part is engaged with the locking part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes a connector according to an embodiment of the present invention in detail with reference to the accompanying drawings. This embodiment does not limit this invention. Components in the following embodiment include ones that those skilled in the art can easily think of and ones that are substantially the same.

Embodiment

Figure 1:
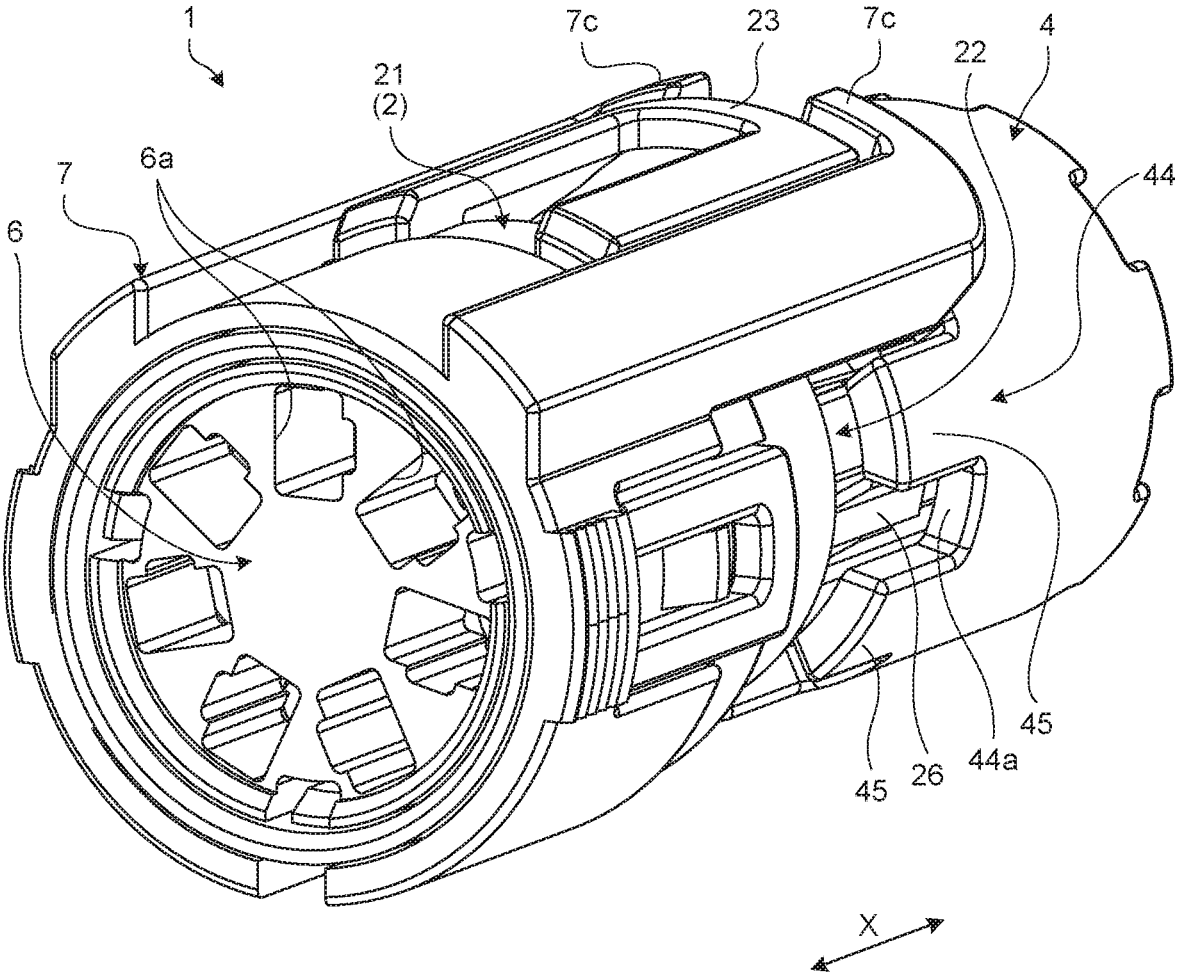
FIG. 1 is a perspective view of a connector of an embodiment.
Figure 2:
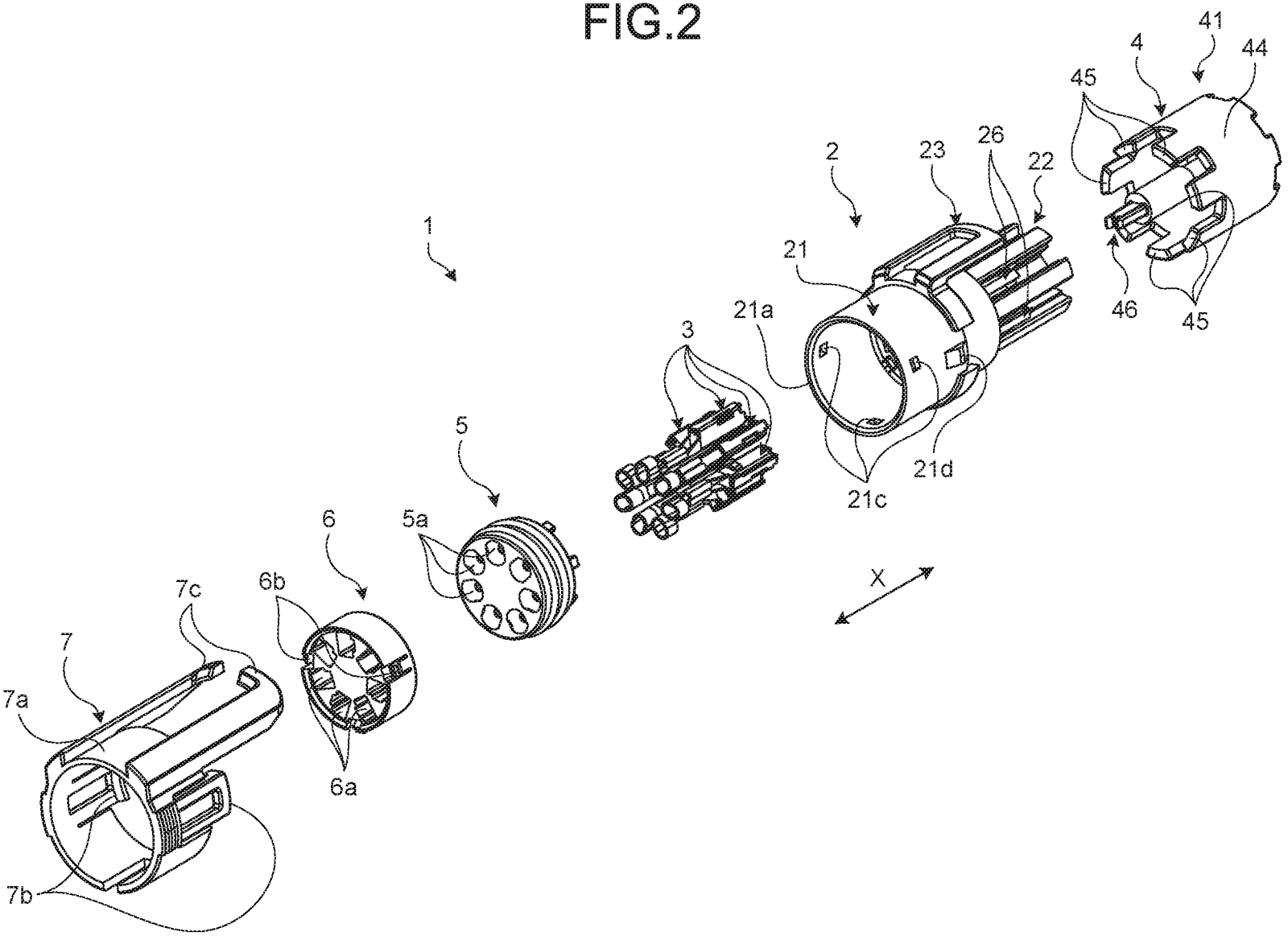
FIG. 2 is an exploded perspective view of the connector of the embodiment.
Figure 3:
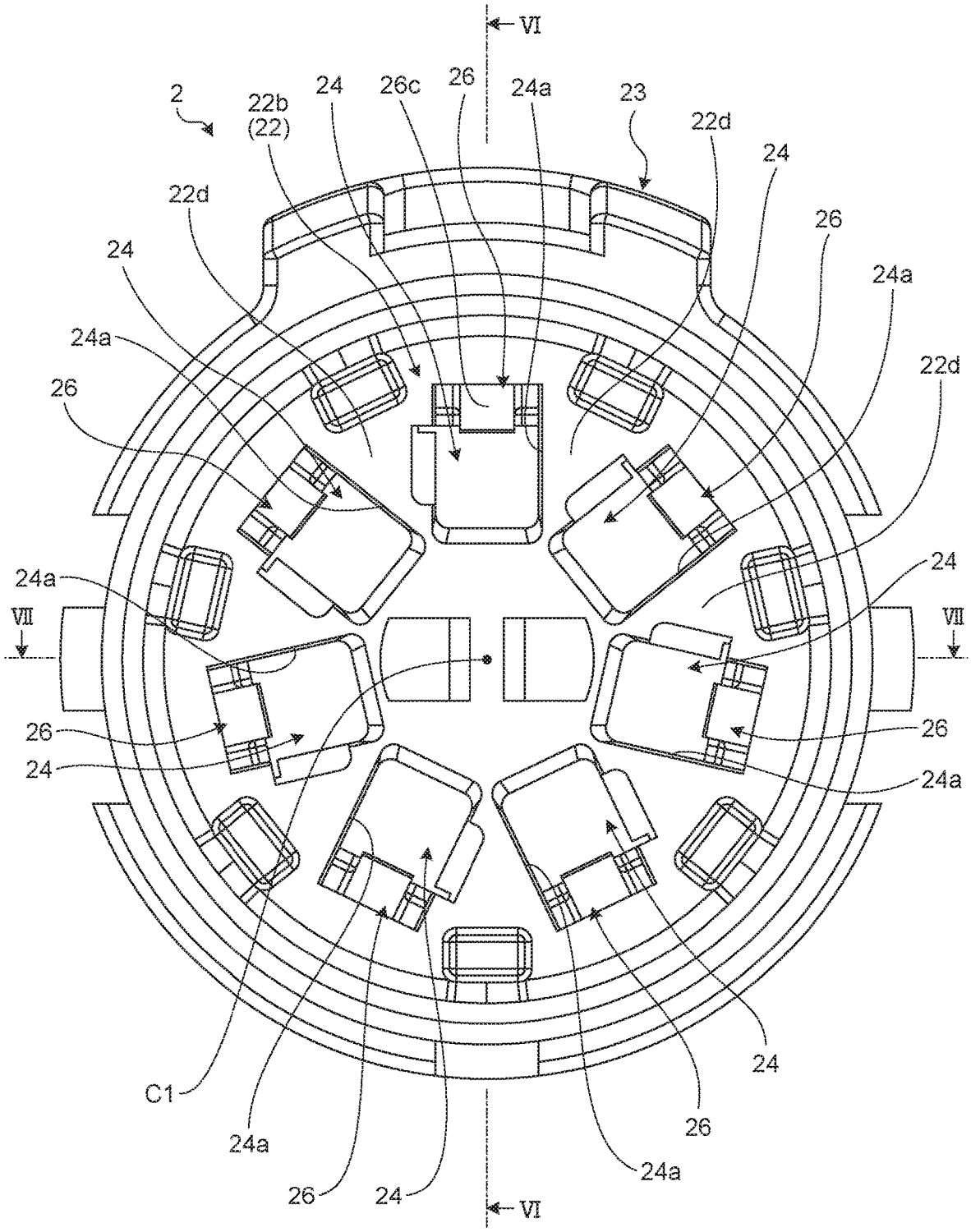
FIG. 3 is a back elevation of a housing according to the embodiment.
Figure 4:
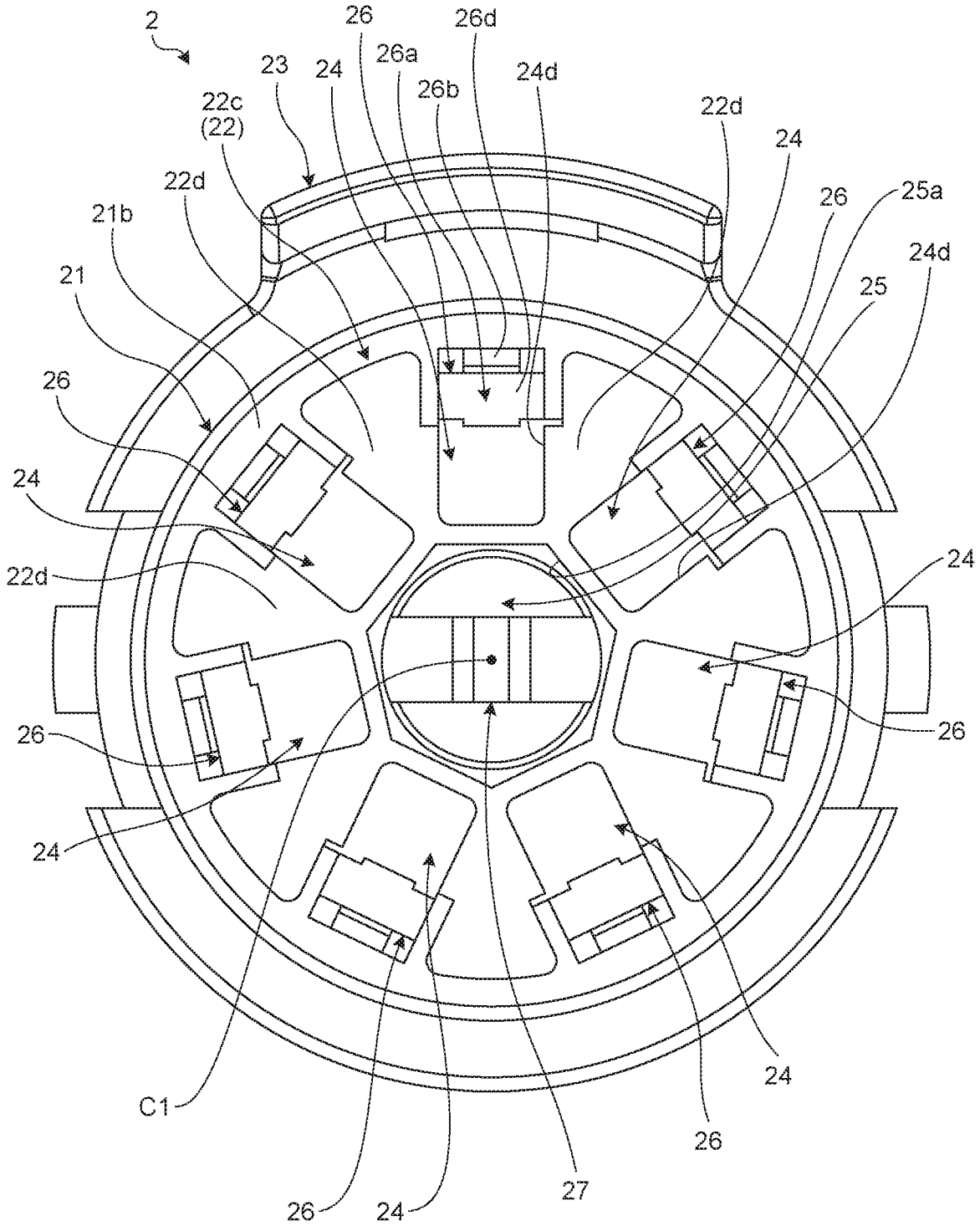
FIG. 4 is a front elevation of the housing according to the embodiment.
Figure 5:
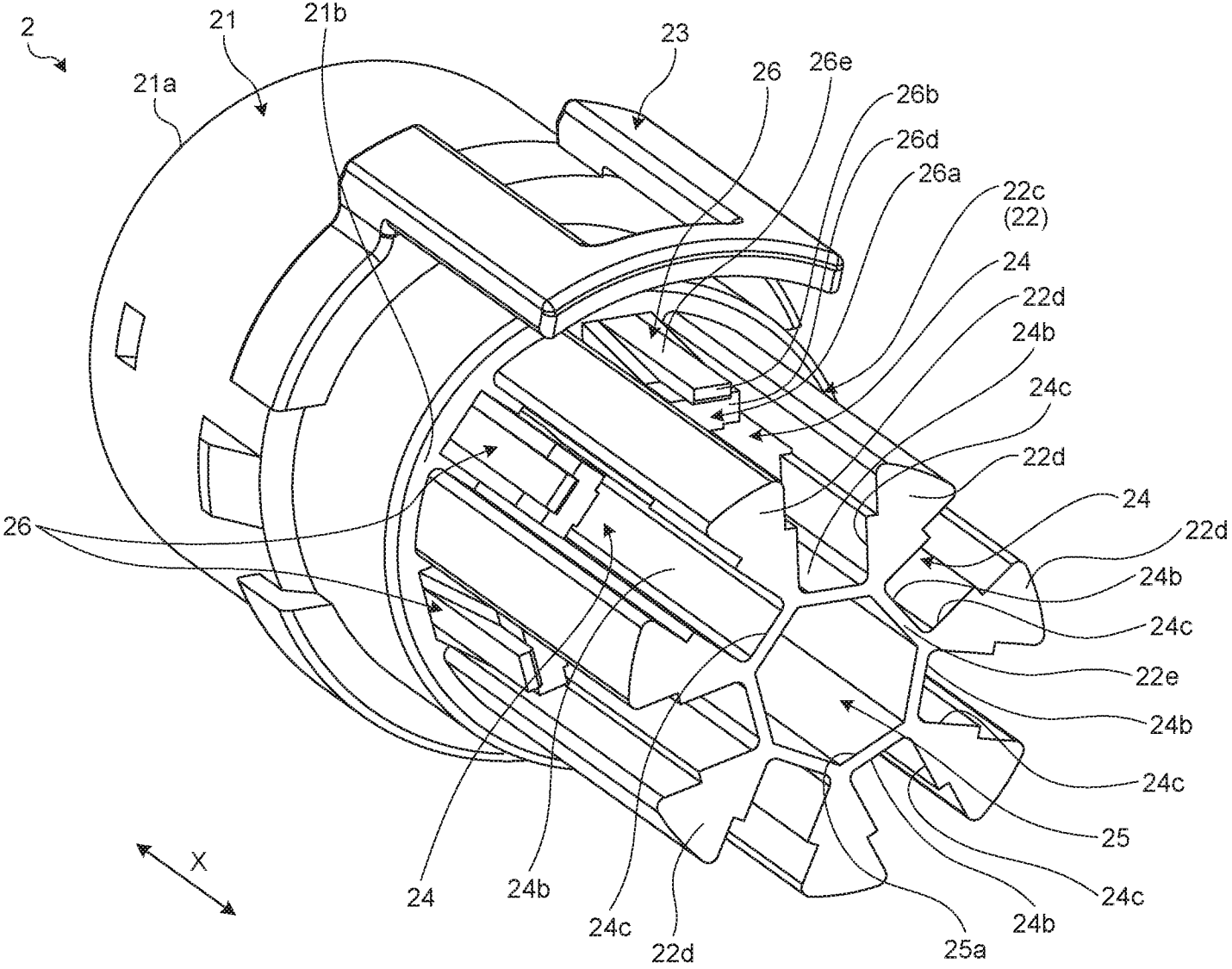
FIG. 5 is a perspective view of the housing according to the embodiment.
Figure 6:
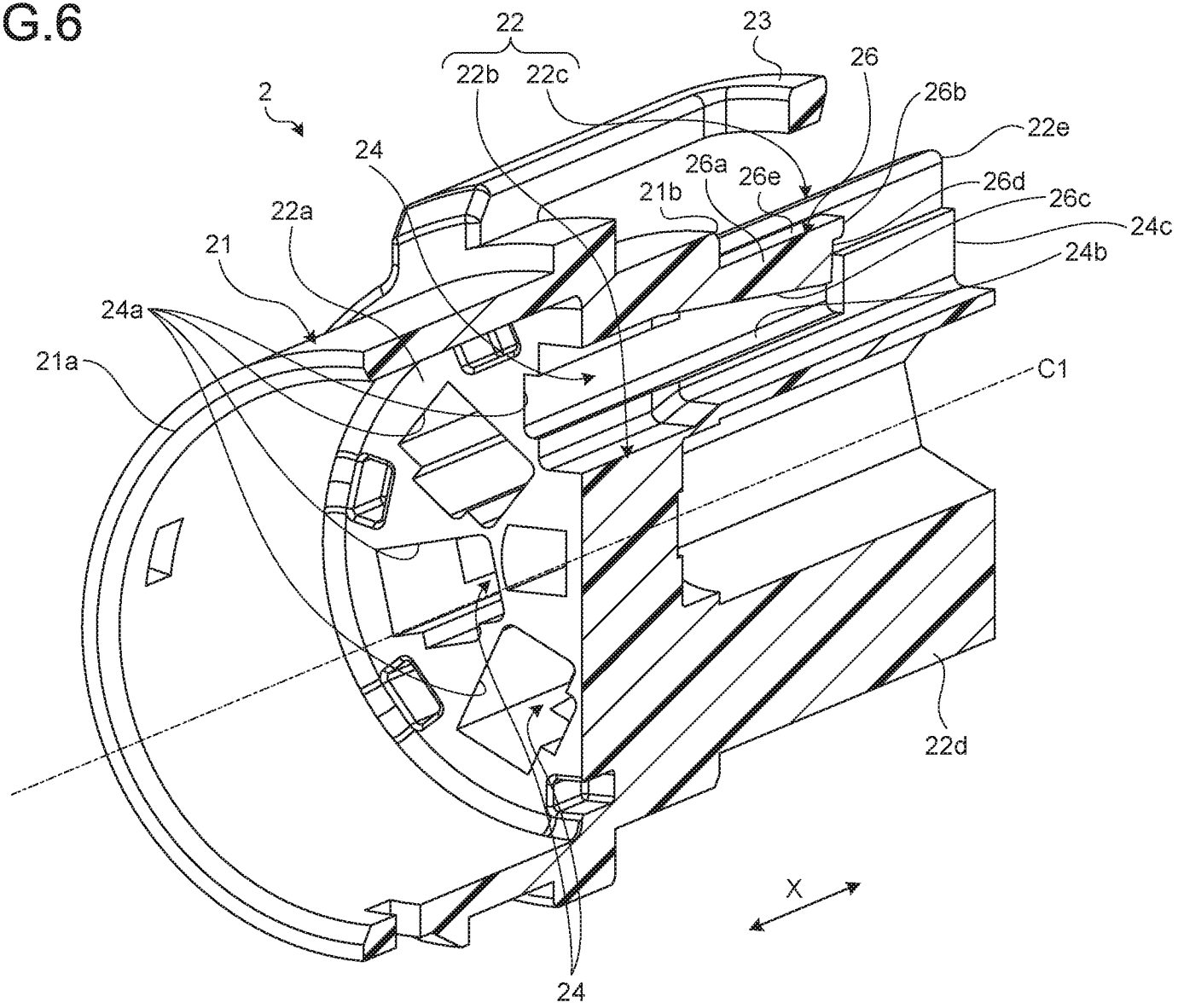
FIG. 6 is a sectional perspective view of the housing according to the embodiment.
Figure 7:
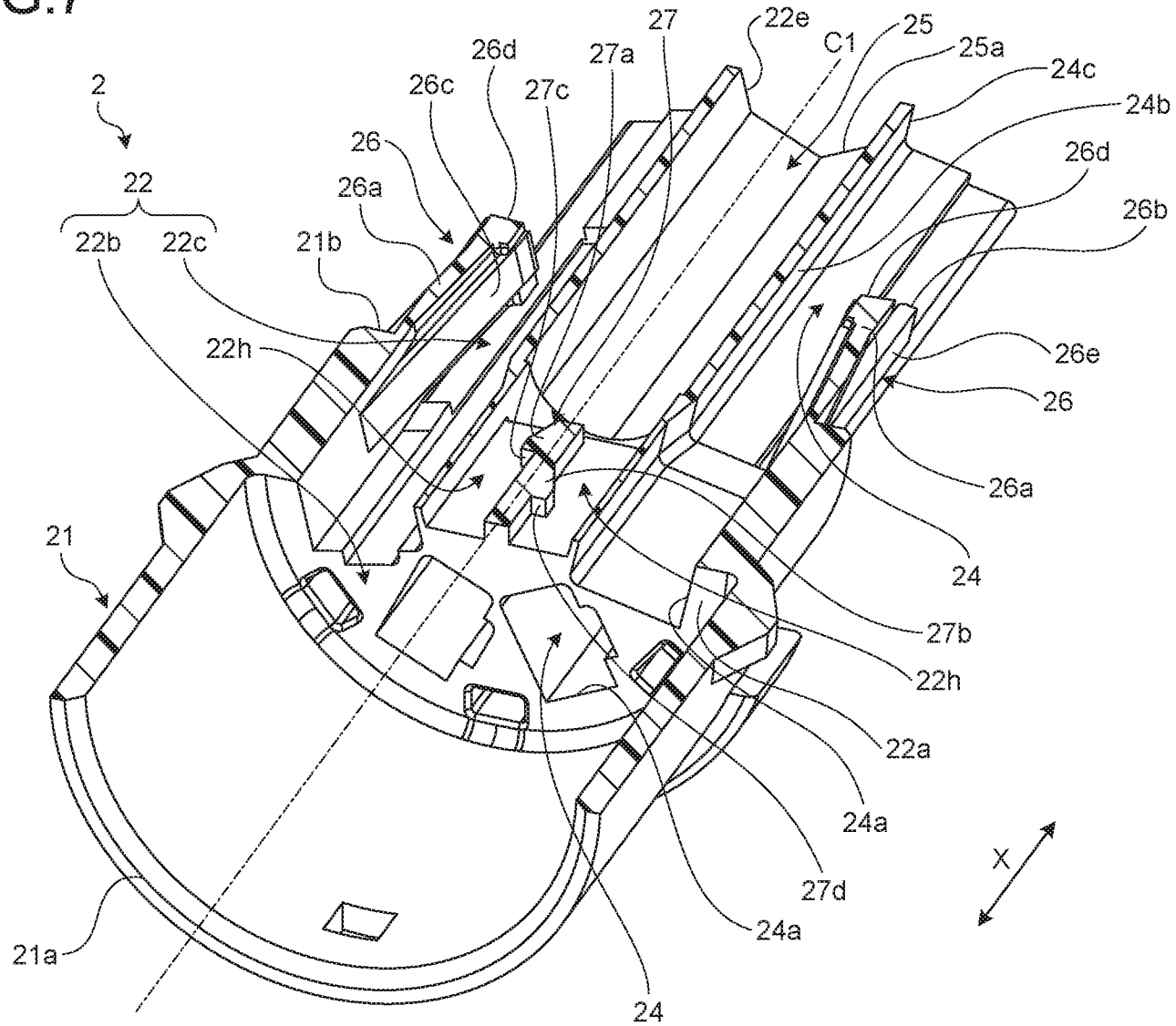
FIG. 7 is a sectional perspective view of the housing according to the embodiment.
Figure 8:
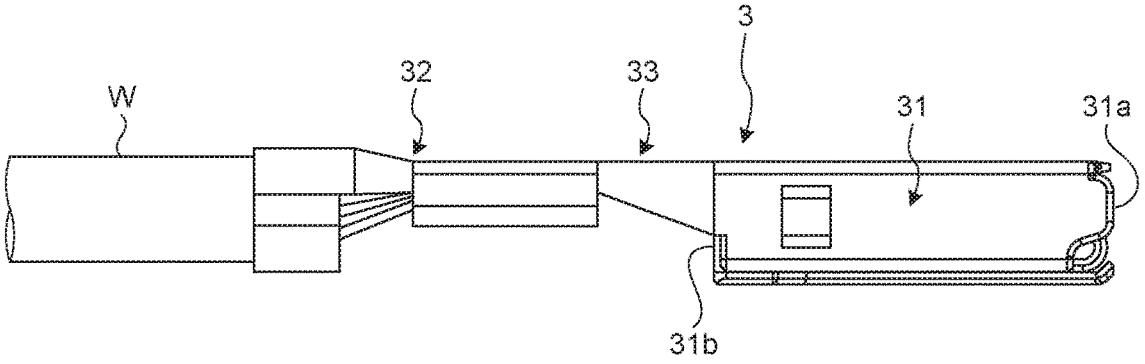
FIG. 8 is a side view of a female terminal according to the embodiment.
Figure 9:
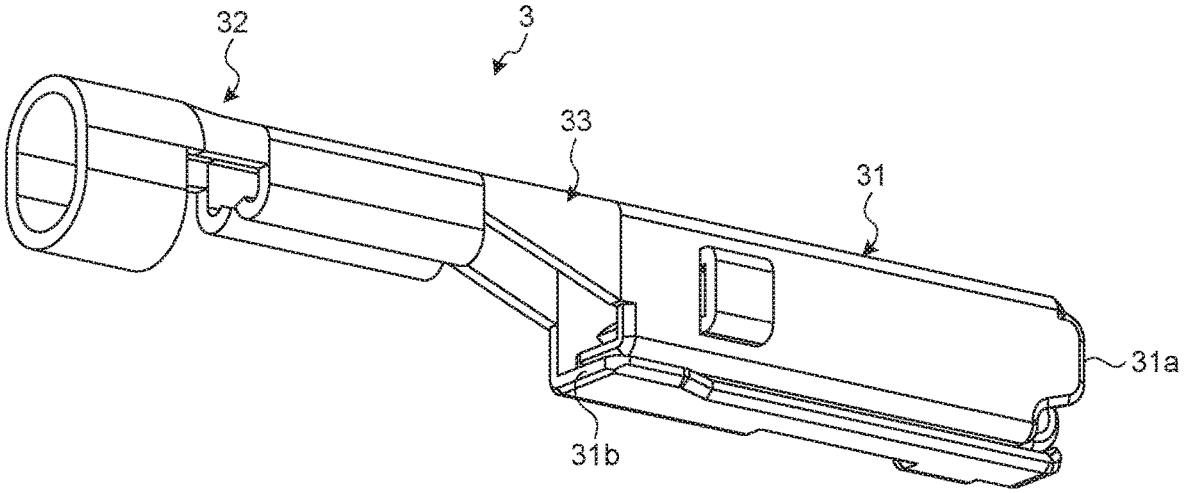
FIG. 9 is a perspective view of the female terminal according to the embodiment.
Figure 10:
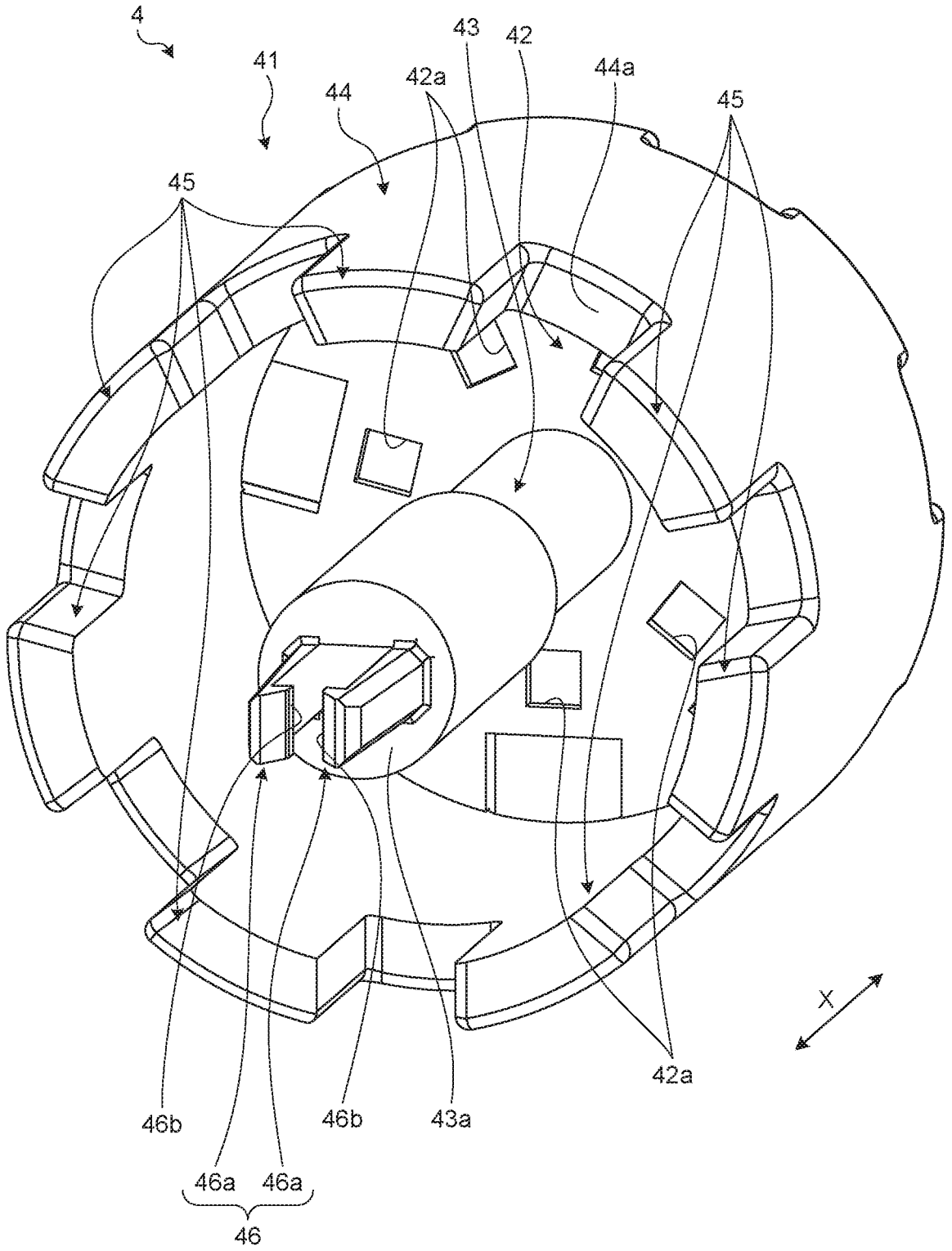
FIG. 10 is a perspective view of a detection member according to the embodiment.
Figure 11:
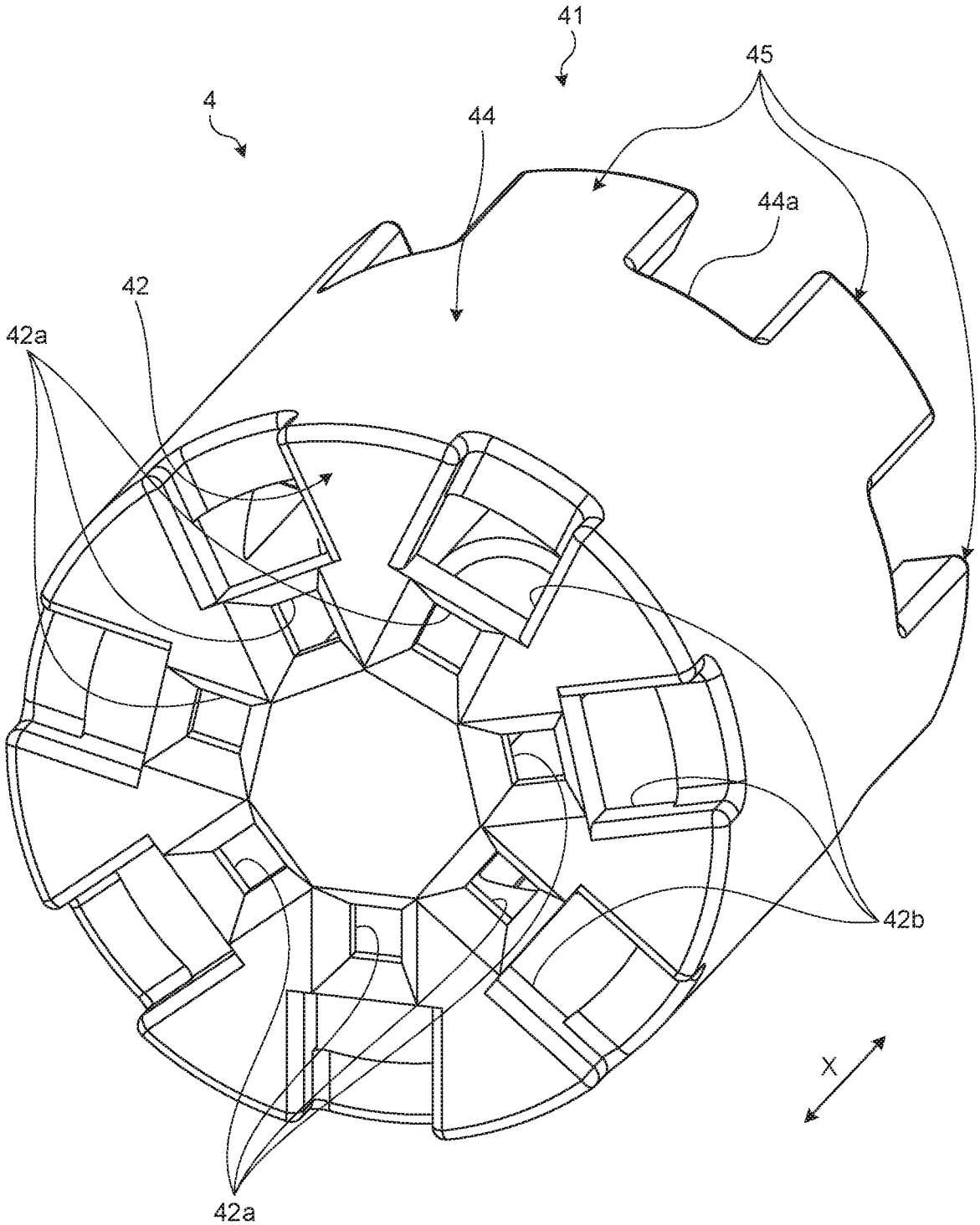
FIG. 11 is a perspective view of the detection member according to the embodiment.

The following describes an embodiment with reference to FIG. 1 to FIG. 16. The present embodiment relates to a connector. FIG. 1 is a perspective view of the connector of the embodiment; FIG. 2 is an exploded perspective view of the connector of the embodiment; FIG. 3 is a back elevation of a housing according to the embodiment; FIG. 4 is a front elevation of the housing according to the embodiment; FIG. 5 is a perspective view of the housing according to the embodiment; FIG. 6 is a sectional perspective view of the housing according to the embodiment; FIG. 7 is a sectional perspective view of the housing according to the embodiment; FIG. 8 is a side view of a female terminal according to the embodiment; FIG. 9 is a perspective view of the female terminal according to the embodiment; FIG. 10 is a perspective view of a detection member according to the embodiment; and FIG. 11 is a perspective view of the detection member according to the embodiment.

Figure 12:
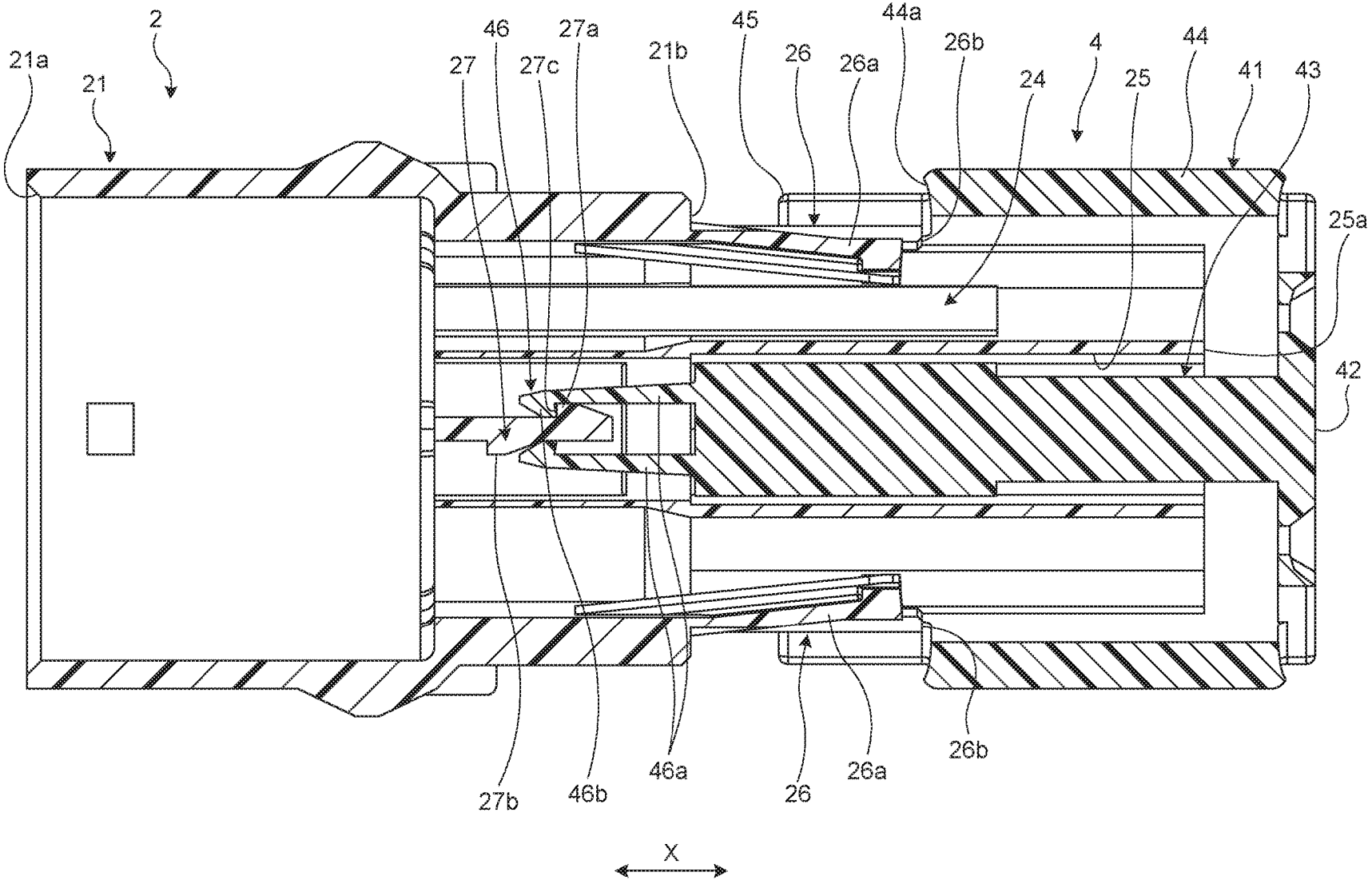
FIG. 12 is a sectional view of the detection member temporarily locked to the housing.
Figure 13:
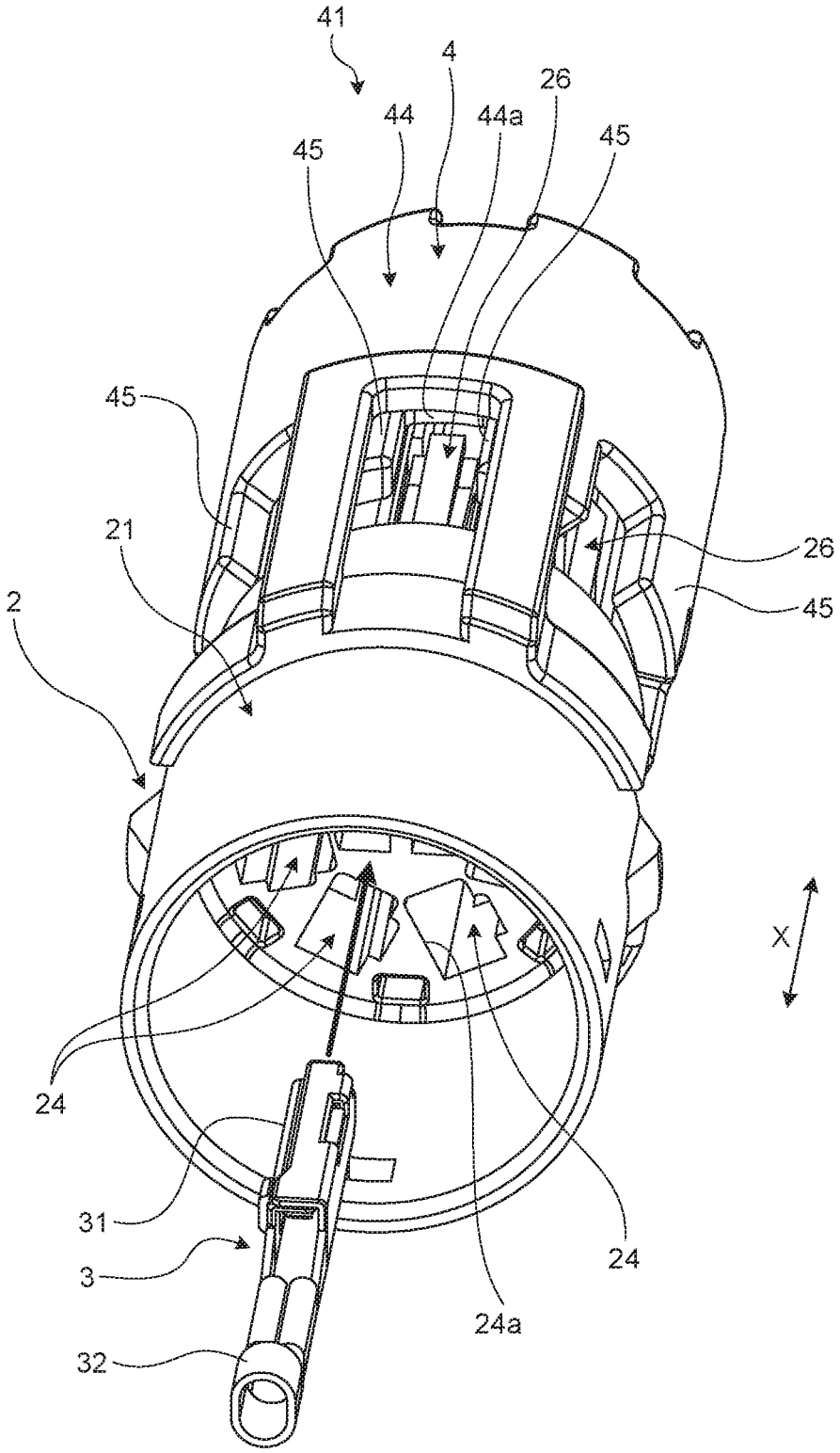
FIG. 13 is a perspective view of the female terminal being inserted into the housing.
Figure 14:
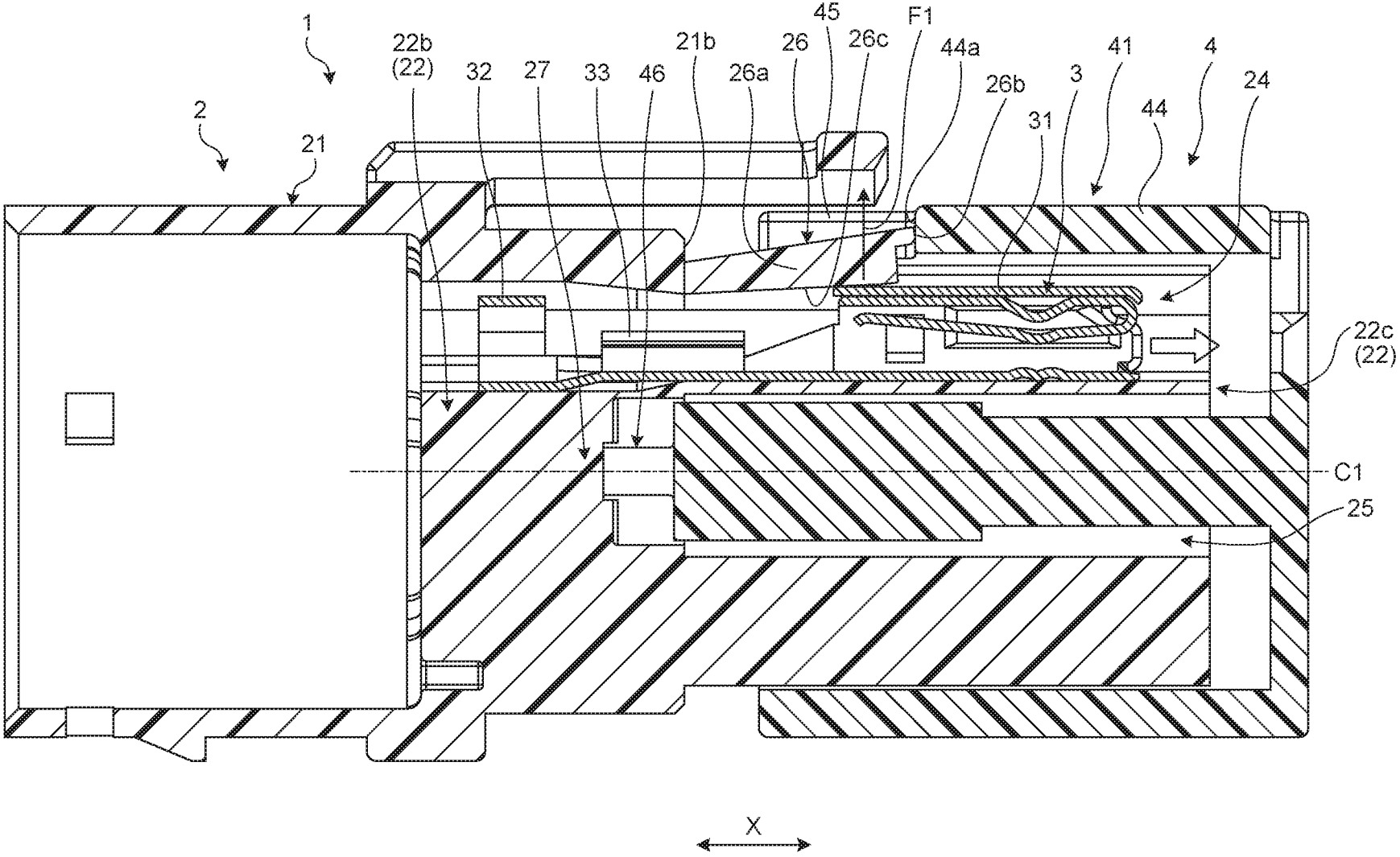
FIG. 14 is a sectional view of the female terminal being inserted into a terminal housing chamber.
Figure 15:
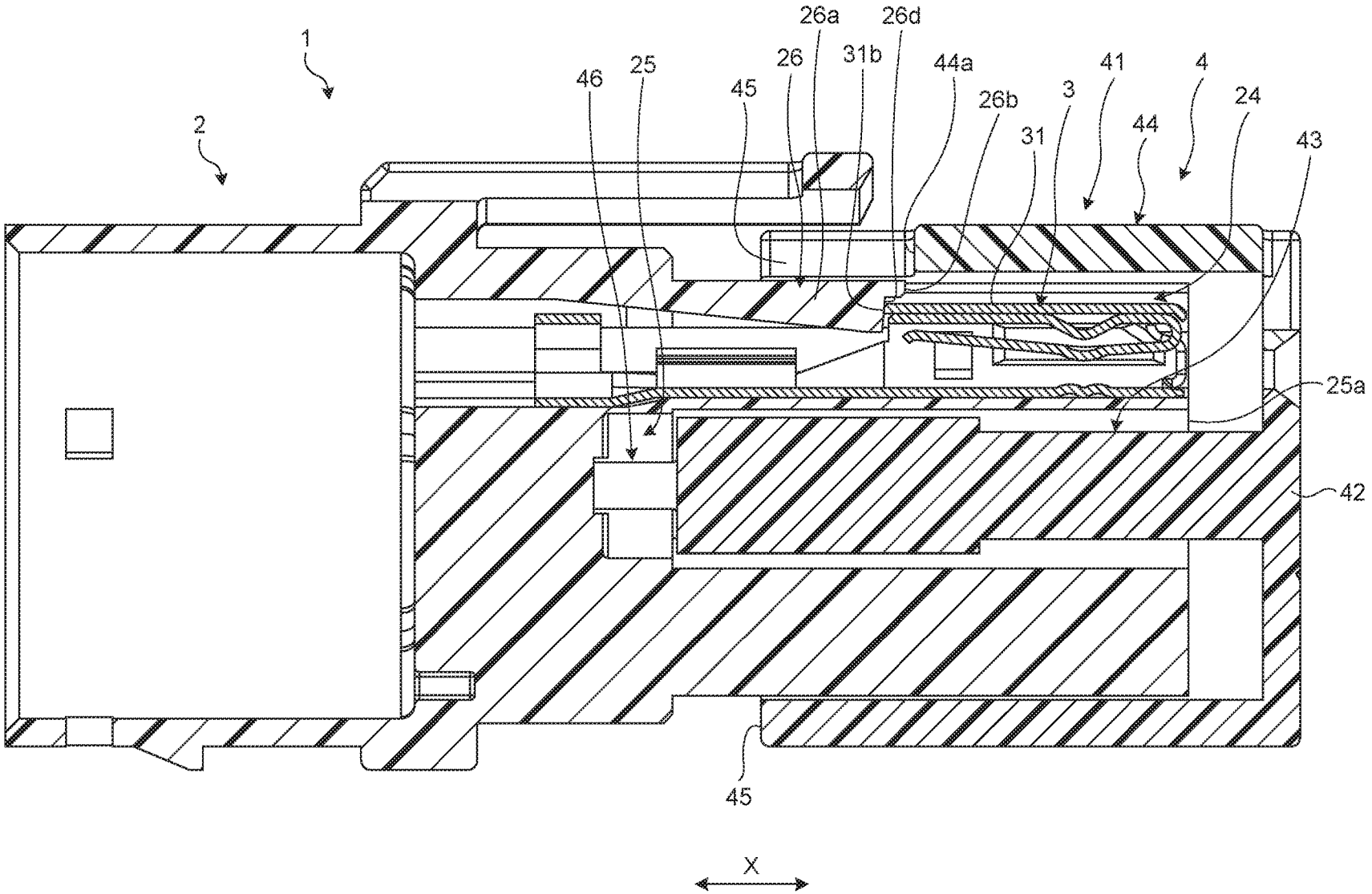
FIG. 15 is a sectional view of the female terminal that has been inserted into a regular position.
Figure 16:
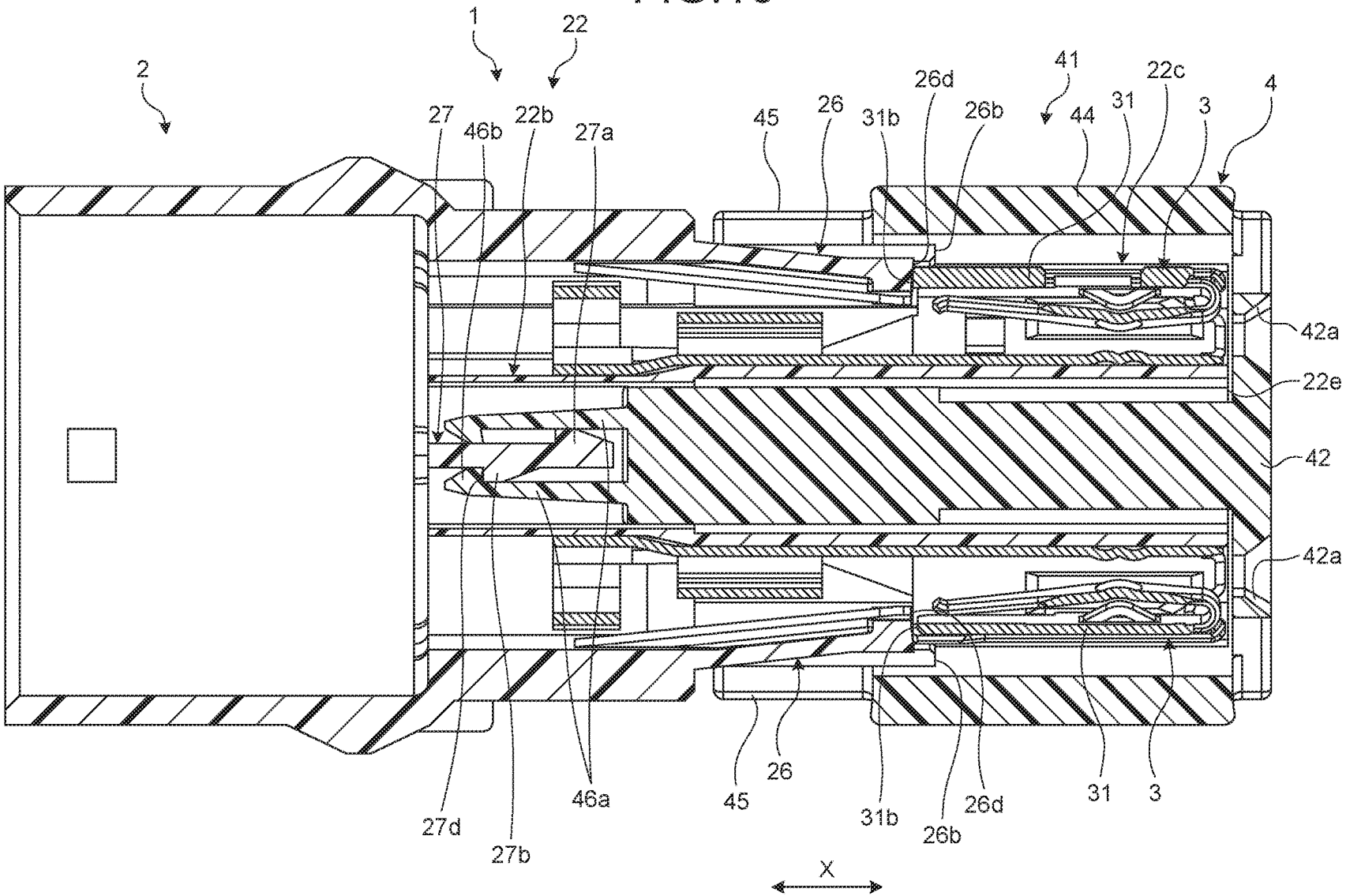
FIG. 16 is a sectional view of the detection member that has been inserted into a main locking position.

FIG. 12 is a sectional view of the detection member temporarily locked to the housing; FIG. 13 is a perspective view of the female terminal being inserted into the housing; FIG. 14 is a sectional view of the female terminal being inserted into a terminal housing chamber; FIG. 15 is a sectional view of the female terminal that has been inserted into a regular position; and FIG. 16 is a sectional view of the detection member that has been inserted into a main locking position. FIG. 6 illustrates the VI-VI section of FIG. 3. FIG. 7 illustrates the VII-VII section of FIG. 3. FIG. 12 and FIG. 16 each illustrate a section of the same position as that of FIG. 7. FIG. 14 and FIG. 15 each illustrate a section of the same position as that of FIG. 6.

As illustrated in FIG. 1 and FIG. 2, this connector 1 of the present embodiment has a housing 2, a plurality of female terminals 3, one detection member 4, a mat seal 5, a seal cover 6, and an unlock cover 7. As illustrated in FIG. 2, the housing 2 has a cylindrical outer wall part 21, a holding part 22, and lances 26. The outer wall part 21, the holding part 22, and the lances 26 are integrally molded with an insulating synthetic resin or the like. The outer wall part 21 is provided with a locking arm 23 locking a counter part connector.

In the following description of the connector 1, an axial direction of the outer wall part 21 is referred to simply as an "axial direction X." The outer wall part 21 has a first opening 21*a*. The first opening 21*a* is an opening at one end of the outer wall part 21 in the axial direction X. The female terminals 3 are inserted from the first opening 21*a* and are held by the holding part 22.

The mat seal 5 is a cylindrical or disc-shaped seal member to be inserted into the inside of the outer wall part 21 from the first opening 21*a*. The mat seal 5 is formed of rubber or the like. The mat seal 5 has a plurality of holes 5*a* through which electric wires are passed. Electric wires to be connected to the female terminals 3 are passed through the holes 5*a*. The mat seal 5 prevents liquid from entering the inside of the housing 2.

The seal cover 6 is a cylindrical or disc-shaped member holding the mat seal 5. The seal cover 6 is molded with an insulting synthetic resin, for example. The seal cover 6 has a plurality of holes 6*a* through which electric wires are passed. A plurality of engaging parts 6*b* are provided on the periphery of the seal cover 6. The engaging parts 6*b* are locked by a plurality of respective locking holes 21*c* provided on the outer wall part 21 of the housing 2.

The unlock cover 7 is a cover member preventing misoperation of the locking arm 23. The unlock cover 7 is molded with an insulating synthetic resin, for example. The unlock cover 7 is mounted on the outside of the outer wall part 21 of the housing 2. The unlock cover 7 has a main body 7*a*, a plurality of engaging parts 7*b*, and a pair of protective arms 7*c*. The main body 7*a* is a part formed in a cylindrical shape and is fit to the outer wall part 21. The engaging parts 7*b* are provided on the main body 7*a* and have flexibility. The engaging parts 7*b* are engaged with a plurality of respective locking protrusions 21*d* provided on the outer wall part 21 of the housing 2.

The protective arms 7*c* protrude along the axial direction X from the main body 7*a*. As illustrated in FIG. 1, when the unlock cover 7 is mounted on the housing 2, the pair of protective arms 7*c* surround the locking arm 23.

The protective arms 7*c* prevent the occurrence of unintentional unlock caused by interference of other components with the locking arm 23.

The following describes details of the housing 2 with reference to FIG. 3 to FIG. 7. As illustrated in FIG. 6 and the like, the holding part 22 has a core part 22*b* and a tubular part 22*c*. The core part 22*b* is a substantially disc-shaped part and is positioned inside the outer wall part 21. More specifically, the core part 22*b* is disposed near an end face 21*b*. The end face 21*b* is an end face of the outer wall part 21 positioned on the side opposite to the first opening 21*a*. The tubular part 22*c* extends along the axial direction X from the end face 21*b*. The tubular part 22*c* is a substantially cylindrical part and is continuous with the core part 22*b*.

The holding part 22 has a plurality of terminal housing chambers 24. The terminal housing chambers 24 are formed across the core part 22*b* and the tubular part 22*c*. A terminal housing chamber 24 has a terminal insertion port 24*a* and a tab insertion port 24*c*. The terminal insertion port 24*a* is formed in an end face 22*a* of the core part 22*b* and opens toward the first opening 21*a*. The end face 22*a* is an end face of the core part 22*b* on one side in the axial direction X and is directed toward the first opening 21*a*. The tab insertion port 24*c* is formed in an end face 22*e* of the tubular part 22*c*. A tab of a male terminal is inserted into the terminal housing chamber 24 from the tab insertion port 24*c*. The terminal housing chambers 24 extend along the axial direction X from the terminal insertion port 24*a* to the tab insertion port 24*c*. The terminal housing chambers 24 include a groove part 24*b* formed in the tubular part 22*c*. The groove part 24*b* opens radially outward.

In the present embodiment, as illustrated in FIG. 3, FIG. 6, and the like, the terminal housing chambers 24 are disposed along a circumferential direction. More specifically, the terminal housing chambers 24 are disposed at regular intervals along the circumferential direction around a center line C1. The center line C1 is a line along the axial direction X and is a central axial line of the holding part 22, for example. The housing 2 of the present embodiment has seven terminal housing chambers 24 disposed at regular intervals. The holding part 22 has radial partitioning walls 22*d* each partitioning adjacent terminal housing chambers 24 from each other.

As illustrated in FIG. 4, FIG. 5, and the like, the housing 2 has a passage part 25. The passage part 25 is a hollow part of the tubular part 22*c* and is a passage-shaped space part into which a shaft part 43 of the detection member 4 is inserted. The passage part 25 extends along the center line C1 and is provided concentrically with the center line C1, for example. The sectional shape of the passage part 25 of the present embodiment is heptagonal. An opening 25*a* of the passage part 25 is formed in the end face 22*e* of the tubular part 22*c*. The passage part 25 extends along the axial direction X from the opening 25*a* toward the first opening 21*a*. The shaft part 43 of the detection member 4 is inserted into the passage part 25 from the opening 25*a*. That is to say, the direction in which the detection member 4 is fit to the passage part 25 and the direction in which the female terminal 3 is inserted into the terminal housing chamber 24 are opposite to each other.

As illustrated in FIG. 4 and FIG. 5, the housing 2 has a plurality of lances 26. The lances 26 protrude along the axial direction X from the end face 21*b* of the outer wall part 21. A basal end of a lance 26 is supported on the outer wall part 21, whereas a distal end of the lance 26 is a free end. One lance 26 is provided for one terminal housing chamber 24. The lance 26 is disposed between two adjacent partitioning walls 22*d*. In other words, the lances 26 and the partitioning walls 22*d* are alternately disposed along the circumferential direction. The lance 26 is positioned radially outside the groove part 24*b* of the terminal housing chamber 24. That is to say, the lance 26 is disposed so as to block the groove part 24*b* from the radial outside.

The lance 26 has a main body 26*a* and a locking protrusion 26*b*. The main body 26*a* has an inclined face 26*c* and a locking face 26*d*. The inclined face 26*c* is a face directed toward the terminal housing chamber 24 and is inclined relative to the axial direction X. More specifically, the inclined face 26*c* is inclined so as to be closer to the center line C1 as the distance to the end face 22*e* decreases along the axial direction X. The locking face 26*d* is a face locking the female terminal 3. The locking face 26*d* is directed toward the end face 22*e*.

The locking protrusion 26*b* protrudes along the axial direction X from the main body 26*a*. The locking protrusion 26*b* protrudes toward the end face 22*e* from a radially outer end of the locking face 26*d*. An outer face 26*e* of the lance 26 is a common face shared by the main body 26*a* and the locking protrusion 26*b*. The outer face 26*e* is parallel to the axial direction X with the lance 26 without bending.

As illustrated in FIG. 7 and the like, the core part 22*b* has a locking part 27. The locking part 27 is a part engaged with the detection member 4 to lock the detection member 4. The locking part 27 is positioned at the innermost part of the passage part 25 when viewed from the end face 22*e*. The locking part 27 is disposed concentrically with the center line C1. In the core part 22*b*, a space part 22*h* is provided beside the locking part 27. The locking part 27 extends along the axial direction X.

The locking part 27 has a first locking part 27*a* and a second locking part 27*b*. The first locking part 27*a* and the second locking part 27*b* protrude in a direction crossing the axial direction X. The first locking part 27*a* and the second locking part 27*b* protrude in opposite directions. The first locking part 27*a* and the second locking part 27*b* are disposed at different positions in the axial direction X. The first locking part 27*a* is positioned closer to the end face 22*e* than the second locking part 27*b* is. In other words, the first locking part 27*a* is positioned closer to an entrance of the passage part 25 than the second locking part 27*b* is. The first locking part 27*a* and the second locking part 27*b* have locking faces 27*c* and 27*d*, respectively, directed toward the first opening 21*a*. The locking face 27*c* of the first locking part 27*a* stops the detection member 4 at a temporary locking position. The locking face 27*d* of the second locking part 27*b* stops the detection member 4 at a main locking position.

As illustrated in FIG. 8 and FIG. 9, the female terminal 3 has a terminal connection part 31, an electric wire connection part 32, and an intermediate part 33. The female terminal 3 is formed of metal having conductivity such as copper. The terminal connection part 31 is a part to be electrically connected to a male terminal 13 and has a rectangular tubular shape. A tab 13*a* of the male terminal 13 is inserted into the terminal connection part 31 from a tip 31*a* of the terminal connection part 31 to be electrically connected to the terminal connection part 31. The electric wire connection part 32 is a part to be connected to an electric wire W. The electric wire connection part 32 is crimped onto a core and a clad of the electric wire W. In FIG. 9 and the subsequent drawings, illustration of the electric wire W is omitted. The intermediate part 33 is a part connecting a rear end 31*b* of the terminal connection part 31 and the electric wire connection part 32 to each other.

As illustrated in FIG. 10 and FIG. 11, the detection member 4 has a fitting part 41, a first wall part 42, a shaft part 43, and an engaging part 46. The fitting part 41, the first wall part 42, the shaft part 43, and the engaging part 46 are integral with each other. The detection member 4 is molded with an insulating synthetic resin, for example. The fitting part 41 is a part formed in a tubular shape to be fit to the tubular part 22*c* of the housing 2. The fitting part 41 has a cylinder part 44 and a plurality of protruding parts 45. The cylinder part 44 is a main body of the fitting part 41 and has a cylindrical shape. The sectional shape of the cylinder part 44 is annular. That is to say, the cylinder part 44 is continuous across the entire circumference along the circumferential direction.

The protruding parts 45 protrude along the axial direction X from an end face 44*a* of the cylinder part 44. The protruding parts 45 are disposed at regular intervals along the circumferential direction. A gap corresponding to the lance 26 is provided between two adjacent protruding parts 45. The detection member 4 of the present embodiment has seven protruding parts 45 in accordance with the number of the lances 26. The sectional shape of a protruding part 45 is arcuate corresponding to the sectional shape of the cylinder part 44. That is to say, the shape of an outer face of the protruding part 45 is arcuate corresponding to the shape of an outer face of the cylinder part 44. The shape of an inner face of the protruding part 45 is arcuate corresponding to the shape of an inner face of the cylinder part 44.

The first wall part 42 is a flat wall part blocking one end of the cylinder part 44. The first wall part 42 is disposed at an end of the cylinder part 44 on the side opposite to the end face 44*a*. The first wall part 42 has a plurality of tab insertion holes 42*a*. A tab insertion hole 42*a* is a through hole through which the tab of the male terminal is passed. The tab insertion holes 42*a* are disposed at regular intervals along the circumferential direction. The first wall part 42 has a plurality of through holes 42*b*. The through holes 42*b* are disposed at regular intervals along the circumferential direction. The through holes 42*b* are formed at positions facing the respective lances 26 in the axial direction.

As illustrated in FIG. 10, the shaft part 43 protrudes along the axial direction X from the center of the first wall part 42. The shaft part 43 extends in an inner space of the cylinder part 44 and protrudes toward an outer space of the fitting part 41. The engaging part 46 is provided at the tip of the shaft part 43. The engaging part 46 has a pair of arms 46*a* and 46*a* having flexibility. The arms 46*a* protrude in the axial direction X from a tip face 43*a* of the shaft part 43. Each of the arms 46*a* has a hook part 46*b* protruding in a direction crossing the axial direction X. Two hook parts 46*b* face each other in a direction orthogonal to the axial direction X.

Before the female terminals 3 are mounted on the housing 2, the detection member 4 is temporarily locked to the housing 2. FIG. 12 illustrates the detection member 4 temporarily locked to the housing 2. The engaging part 46 and the shaft part 43 of the detection member 4 are inserted into the passage part 25 from the opening 25*a*. The engaging part 46 is engaged with the first locking part 27*a* of the housing 2. The first locking part 27*a* locks one hook part 46*b* to prevent the shaft part 43 from moving in a direction getting out of the passage part 25. The second locking part 27*b* comes into contact with the other hook part 46*b* to position the engaging part 46. That is to say, the detection member 4 stops with the hook parts 46*b* being positioned between the first locking part 27*a* and the second locking part 27*b*. In the following description, a state in which the engaging part 46 is engaged with the first locking part 27*a* is referred to as a "temporary locking state." The temporary locking state of the detection member 4 is a position at which the engaging part 46 is engaged with the first locking part 27*a*.

As described below, in the temporary locking state, the lances 26 can bend without interfering with the fitting part 41. As illustrated in FIG. 13, in the temporary locking state, the lances 26 are exposed toward an outer space of the detection member 4. More specifically, in the circumferential direction, the lance 26 is positioned between the two protruding parts 45. As illustrated in FIG. 12, the end face 44*a* of the cylinder part 44 is positioned closer to the opening 25*a* than the locking protrusion 26*b* of the lance 26 is. Consequently, in a space surrounded by the two protruding parts 45 and the end face 44*a*, the lance 26 can bend radially outward.

As illustrated in FIG. 13, the female terminal 3 is inserted into the terminal housing chamber 24 with the terminal connection part 31 as the top. As illustrated in FIG. 14, the female terminal 3 advances to an inner part of the terminal housing chamber 24 while pushing up the lance 26 by the terminal connection part 31. The lance 26 bends through a pressing force F1 received from the terminal connection part 31. The locking protrusion 26*b* of the lance 26 moves radially outward to face the end face 44*a* of the cylinder part 44 in the axial direction X.

FIG. 15 illustrates the female terminal 3 that has been inserted into the regular position in the terminal housing chamber 24. When the female terminal 3 is inserted toward the inner part of the terminal housing chamber 24 from the position illustrated in FIG. 14, the main body 26*a* of the lance 26 climbs over the terminal connection part 31. The lance 26 moves radially inward through an elastic restoration force of the lance 26. In other words, the shape of the lance 26 restores its shape before the lance 26 bends. The locking face 26*d* of the lance 26 faces the rear end 31*b* of the terminal connection part 31 in the axial direction X to lock the terminal connection part 31. That is to say, the locking face 26*d* prevents the female terminal 3 from moving in a direction in which the female terminal 3 gets out of the terminal housing chamber 24. The locking protrusion 26*b* of the lance 26 is positioned more radially inward than the end face 44*a* of the cylinder part 44 is. That is to say, the lance 26 is at a position from which it can enter the inside of the cylinder part 44 when the detection member 4 is further pushed in.

When all the female terminals 3 are inserted into the terminal housing chambers 24, an operator pushes the detection member 4 into the main locking position. FIG. 16 illustrates the detection member 4 that has been inserted into the main locking position. When the detection member 4 is inserted into the main locking position, the engaging part 46 is engaged with the second locking part 27*b* of the housing 2. The second locking part 27*b* locks the hook parts 46*b* to prevent the shaft part 43 from moving in a removing direction from the passage part 25. In the following description, a state in which the engaging part 46 is engaged with the second locking part 27*b* is referred to as a "main locking state."

In the main locking state, the lance 26 enters the inside of the cylinder part 44. That is to say, the lance 26 enters the inside of the cylinder part 44 when the detection member 4 is inserted from the temporary locking position to the main locking position. The lance 26 enters the inside of the cylinder part 44 to allow the engaging part 46 to be engaged with the second locking part 27*b*. The lance 26 enters the inside of the cylinder part 44, whereby a lock state, in which the lance 26 locks the terminal connection part 31 is maintained. The cylinder part 44 prevents the lance 26 from becoming deformed radially outward and prevents the occurrence of any unintentional unlock. The protruding part 45 is positioned radially outside the lance 26 to protect the lance 26. The protruding part 45 prevents other components and apparatuses from interfering with the lance 26.

In the main locking state, the tubular part 22*c* of the housing 2 is inserted into the fitting part 41 of the detection member 4 to be fit to the fitting part 41. In other words, the tubular part 22*c* is covered with the fitting part 41 from the radial outside. In the main locking state, the first wall part 42 of the detection member 4 faces the end face 22*e* of the tubular part 22*c*. The size of a gap between the first wall part 42 and the end face 22*e* is made small enough to be able to reduce wobbling between the engaging part 46 and the second locking part 27*b*.

In the connector 1 of the present embodiment, as described below, the detection member 4 detects a semi-insertion state, in which the female terminal 3 is not inserted into the regular position. As described with reference to FIG. 14, when the female terminal 3 is not inserted into the regular position in the terminal housing chamber 24, the locking protrusion 26*b* of the lance 26 faces the end face 44*a* of the cylinder part 44. Even when the operator attempts to insert the detection member 4 to the main locking position in this state, the lance 26 prevents the detection member 4 from moving. The lance 26 prevents the detection member 4 from moving along the axial direction X so as not to cause the engaging part 46 to be engaged with the second locking part 27*b*. Consequently, when the detection member 4 cannot be pushed in, the operator can determine that there are some female terminals 3 in the semi-insertion state.

A position of the fitting part 41 when the lance 26 locks the cylinder part 44 is referred to as a "first position." The first position is a position between the main locking position and the temporary locking position, for example. That is to say, when there are some female terminals 3 in the semi-insertion state, the fitting part 41 is locked by the lance 26 at the first position, which is short of the main locking position. The lance 26 locks the fitting part 41 at the first position to disable the engaging part 46 to be engaged with the second locking part 27*b*.

As described in the foregoing, the connector 1 of the present embodiment has the female terminals 3, the housing 2, and the detection member 4. The housing 2 has the tubular outer wall part 21, the holding part 22, the lances 26, and the second locking part 27*b*. The holding part 22 extends along the axial direction X of the outer wall part 21 and has the terminal housing chambers 24. The lances 26 are supported on the outer wall part 21 and are positioned radially outside the respective terminal housing chambers 24. The detection member 4 has the tubular fitting part 41 to be fit to the holding part 22 along the axial direction X and the engaging part 46 to be engaged with the second locking part 27*b*.

The terminal housing chambers 24 are disposed along the circumferential direction around the center line C1 of the housing 2. The lances 26, when the respective female terminals 3 are inserted into the regular position in the respective terminal housing chambers 24, are engaged with the respective female terminals 3 to lock the respective female terminals 3. The lances 26, when the respective female terminals 3 are inserted into the regular position in the respective terminal housing chambers 24, enter the inside of the fitting part 41 when the fitting part 41 is fit to the holding part 22 to allow the engaging part 46 to be engaged with the second locking part 27*b*.

On the other hand, the lances 26, when the respective female terminals 3 are not inserted into the regular position, are pressed by the respective female terminals 3 to become deformed radially outward and to lock the fitting part 41 at the first position, which is short of a position at which the engaging part 46 is engaged with the second locking part 27*b*. In the connector 1 of the present embodiment, a part locked by the lances 26 is the tubular fitting part 41. Consequently, an increase in the size of the detection member 4 can be prevented while ensuring the strength of the contact part locked by the lances 26.

As a comparative example against the present embodiment, a detection member provided with individual contact parts for the lances 26 inside the fitting part 41 is considered. In the detection member of the comparative example, when the strength of the contact part is attempted to be increased, the detection member increases in size. In contrast, the detection member 4 of the present embodiment, in which the fitting part 41 also serves as the contact part, achieves both ensuring the strength of the contact part and preventing an increase in the size of the detection member 4.

The fitting part 41 of the present embodiment has the cylinder part 44. A part of the fitting part 41 locked by the lances 26 is the end face 44*a* of the cylinder part 44. The contact part being in contact with the lances 26 has a cylindrical shape, and thus the strength of the contact part is easily ensured.

The holding part 22 of the present embodiment has the partitioning walls 22*d* each partitioning two adjacent terminal housing chambers 24 from each other. The lance 26 is disposed between two adjacent partitioning walls 22*d*. With such a disposition, the partitioning walls 22*d* can protect the lances 26.

The locking part 27 of the present embodiment has the first locking part 27*a* and the second locking part 27*b*. The first locking part 27*a* is engaged with the engaging part 46 to position the fitting part 41 at the temporary locking position, which is short of the first position. The second locking part 27*b* is engaged with the engaging part 46 to position the fitting part 41 at the main locking position, which is a more inner position than the first position. Thus, at the temporary locking position, the fitting part 41 does not interfere with the lance 26, and when the fitting part 41 is locked by the lance 26, the engaging part 46 is disabled to be engaged with the second locking part 27*b*.

Modification of Embodiment

The following describes a modification of the embodiment. The number of the terminal housing chambers 24 is not limited to the exemplified number. The number of the terminal housing chambers 24 of the housing 2 is any number. The shape of the detection member 4 is not limited to the exemplified shape. The engaging part 46 may be provided on the fitting part 41, for example. In this case, a locking part may be provided on an outer circumferential face of the housing 2. The connector 1 may be a male connector having male terminals.

The locking part 27 does not necessarily have the first locking part 27*a*. In other words, the locking part 27 does not necessarily have the function of stopping the fitting part 41 at the temporary locking position. In this case, after all the female terminals 3 are inserted into the housing 2, the detection member 4 is mounted on the housing 2, for example.

The sectional shape of the fitting part 41 is not limited to circular as exemplified. The shape of the fitting part 41 may have a polygonal tubular sectional shape, for example. In this case, the sectional shape of the fitting part 41 may be regularly polygonal corresponding to the number of the terminal housing chambers 24. As an example, when the housing 2 has seven terminal housing chambers 24, the sectional shape of the fitting part 41 may be made regularly heptagonal.

The details disclosed in the embodiment and the modification can be performed in an appropriately combined manner.

In the detection member according to the present embodiment, the part locked by the lances when the respective terminals are not inserted into the regular position is the tubular fitting part. Consequently, the connector according to the present embodiment produces an effect of making it possible to achieve both ensuring the strength of the detection member and preventing an increase in the size of the detection member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a plurality of terminals;

a housing having a tubular outer wall part, a holding part extending along an axial direction of the outer wall part and having a plurality of terminal housing chambers, lances supported on the outer wall part and positioned radially outside the respective terminal housing chambers, and a locking part; and a detection member having a tubular fitting part to be fit to the holding part along the axial direction and an engaging part to be engaged with the locking part, wherein the terminal housing chambers are disposed along a circumferential direction around a center line of the housing, the lances, when the respective terminals are inserted into a regular position in the respective terminal housing chambers, are engaged with the respective terminals to lock the respective terminals and, when the fitting part is fit to the holding part, enter an inside of the fitting part to allow the engaging part to be engaged with the locking part, and the lances, when the respective terminals are not inserted into the regular position, are pressed by the respective terminals to become deformed radially outward and to lock the fitting part at a first position, the first position being short of a position at which the engaging part is engaged with the locking part.

2. The connector according to claim 1, wherein the fitting part has a cylinder part, and a part of the fitting part locked by the lances is an end face of the cylinder part.

3. The connector according to claim 1, wherein the holding part has partitioning walls each partitioning two adjacent terminal housing chambers from each other, and the lances are each disposed between the two adjacent partitioning walls.

4. The connector according to claim 2, wherein the holding part has partitioning walls each partitioning two adjacent terminal housing chambers from each other, and the lances are each disposed between the two adjacent partitioning walls.

5. The connector according to claim 1, wherein the locking part has a first locking part and a second locking part, the first locking part is engaged with the engaging part to position the fitting part at a temporary locking position, the temporary locking position being short of the first position, and the second locking part is engaged with the engaging part to position the fitting part at a main locking position, the main locking position being a more inner position than the first position.

6. The connector according to claim 2, wherein the locking part has a first locking part and a second locking part, the first locking part is engaged with the engaging part to position the fitting part at a temporary locking position, the temporary locking position being short of the first position, and the second locking part is engaged with the engaging part to position the fitting part at a main locking position, the main locking position being a more inner position than the first position.

7. The connector according to claim 3, wherein the locking part has a first locking part and a second locking part, the first locking part is engaged with the engaging part to position the fitting part at a temporary locking position, the temporary locking position being short of the first position, and the second locking part is engaged with the engaging part to position the fitting part at a main locking position, the main locking position being a more inner position than the first position.

8. The connector according to claim 4, wherein the locking part has a first locking part and a second locking part, the first locking part is engaged with the engaging part to position the fitting part at a temporary locking position, the temporary locking position being short of the first position, and the second locking part is engaged with the engaging part to position the fitting part at a main locking position, the main locking position being a more inner position than the first position.

* * * * *